US005158522A

United States Patent [19]

Cummings et al.

[11] Patent Number: 5,158,522

[45] Date of Patent: Oct. 27, 1992

[54] SLITTING CORRUGATED PAPERBOARD BOXES

[75] Inventors: James A. Cummings; Richard F. Paulson, both of Phillips, Wis.

[73] Assignee: Marquip, Inc., Phillips, Wis.

[21] Appl. No.: 763,331

[22] Filed: Sep. 20, 1991

[51] Int. Cl.[5] ..... B21B 1/20

[52] U.S. Cl. ..... 493/370; 83/14; 83/404.2; 83/407; 83/418; 493/71; 493/81; 493/147; 493/182

[58] Field of Search ..... 83/404.1, 404.2, 407, 83/418, 35, 14; 493/53, 54, 71, 81, 147, 182, 59, 60, 370; 198/414, 457

[56] References Cited

U.S. PATENT DOCUMENTS

| | | | |
|---|---|---|---|
| 1,705,748 | 3/1929 | Bridgeman | 493/71 |
| 3,250,162 | 5/1966 | Bunting | 83/39 |
| 3,690,443 | 9/1972 | Snyder | 198/457 |
| 4,618,341 | 10/1986 | Oldham et al. | 198/414 |
| 4,759,741 | 7/1988 | Chisholm, Jr. | 493/182 |
| 5,014,582 | 5/1991 | Teik | 83/110 |

FOREIGN PATENT DOCUMENTS

| | | | |
|---|---|---|---|
| 0017878 | 10/1980 | European Pat. Off. | 83/493 |

*Primary Examiner*—Douglas D. Watts
*Assistant Examiner*—Kenneth E. Peterson
*Attorney, Agent, or Firm*—Andrus, Sceales, Starke & Sawall

[57] ABSTRACT

Knocked down boxes made of corrugated paperboard are slit longitudinally in an on-line process directly downstream from the folder/gluer in which the boxes are formed. The boxes are first reoriented 90° in a horizontal plane from the positions in which they are formed in the folder/gluer to a reoriented position for movement in a direction transverse to the box fold lines, the boxes are formed into a shingle in the direction of movement, and the shingle is conveyed in that direction into an alignment station. In the alignment station, the lateral edges of the boxes in the shingle are aligned vertically, while the shingle moves through the alignment station, by shifting the boxes transversely to the direction of movement. The aligned shingle is moved into a rotary slitting blade positioned above the shingle and having a cutting edge which extends downwardly below the underside of the shingle where it is received in a slot in a shingle support positioned below and on opposite sides of the blade immediately adjacent the slit edges of the shingle.

13 Claims, 2 Drawing Sheets

FLEXO PRINTER
FOLDER/GLUER
COUNTER EJECTOR
CONVEYOR
SHINGLER
SHINGLE SLITTER
DUAL BUNDLE STACKER
BANDER
BOX TURNER

SLITTING CORRUGATED PAPERBOARD BOXES

BACKGROUND OF THE INVENTION

The present invention pertains to slitting boxes made of corrugated paperboard and, in particular, to a method and apparatus for slitting knocked down boxes in an on-line mode as the boxes exit from a folding and gluing apparatus.

Corrugated paperboard box blanks are conventionally printed, folded and glued to form what are referred to as "knocked down boxes" in a flexo-folder-gluer apparatus. This apparatus includes a flexographic printer, a folding mechanism which folds opposite sides of the blank along pre-scored lines, and a gluing device which applies an adhesive along the overlapping edges of the laterally folded sides. The flattened container or knocked down box is thus completely formed and, after the glue dries, the boxes can be stacked and banded for shipment and subsequent assembly. It is known in the art to stack the knocked down boxes exiting the flexo-folder-gluer (hereinafter sometimes referred to as a "flexo") to utilize the stack weight to hold the glue edges together until the glue sets. It is also known in the art to form a shingle of knocked down boxes as they exit from the flexo, also utilizing the weight of the overlapping boxes in the shingle to hold the box position until the adhesive dries.

The knocked down boxes typically assembled in a flexo are of a conventional construction, including four sides, the overlapping edges of two sides of which are glued together on a glue tab, and four slotted end flaps extending integrally from opposite ends of the sides to eventually form the top and bottom closure flaps when the box is subsequently assembled. As indicated, these knocked down boxes are ordinarily finished containers and require no further processing, apart from stacking and banding for shipment. However, it is also known in the art to assemble certain special constructions of knocked down boxes in a flexo, which boxes are subsequently slit into two or more parts to form smaller containers of either a conventional or modified type. For example, it is known to assemble a large regular slotted container (RSC) and subsequently slit the same along a median line to form two half slotted containers, each of which comprises a knocked down container with side walls and bottom flaps or top flaps, but not both. Similarly, a large special regular slotted container can be formed in a flexo-folder-gluer in the form of two integrally attached half size regular slotted containers by forming the blank with special double length center slots which, when bisected as the large special RSC is subsequently slit in half perpendicular to the center slots, form the two half-size RSCs.

Although the formation of the foregoing types of large knocked down boxes, which must be subsequently slit for end use, is well known, production of such boxes on a large scale has never been achieved, primarily because of difficulties in slitting them. Corrugated paperboard sheet stock is conventionally slit longitudinally by the use of a pair of upper and lower cooperating slitting blades which operate as a shear-type cutter. It has been found, however, that such dual knife shear cutters do not provide clean cuts with heavy and/or multi-wall corrugated board. Shear-type slitting inherently causes a vertical displacement of the adjacent slit edges of the board and, as the board thickness increases or as multiple layers are slit, the relative vertical displacement becomes larger and a ragged cut edge typically results. The multiple board layers presented by a knocked down box result in the same characteristic ragged cuts when shear-type slitters are used.

In addition, slitting large special containers exiting a flexo-folder-gluer has typically been done as an off-line process. In other words, the large knocked down boxes are taken off the flexo, moved to another location, and slit individually to form two half-size knocked down boxes. Even with this technique, the longitudinal slits are typically less than satisfactory because of the use of shear-type slitting devices. In addition, registration of the boxes, meaning lateral alignment so that the slit is directly on the centerline of the large regular or special slotted container, is difficult to attain with conventional off-line methods in which one box at a time is slit.

Nevertheless, real advantages in production volume and box quality could be attained with an apparatus and method which would slit large regular or special slotted containers to form two half-size containers in an on-line basis. Furthermore, small containers are typically not run on a flexo-folder-gluer because small container blanks are extremely difficult to handle, not only in the flexo, but in upstream material handling devices as well. Thus, there is a real need in the industry for a system which can provide for the manufacture of high quality small size knocked down boxes, but will also utilize a flexo-folder-gluer in its most effective and efficient manner.

In one known prior art method, the on-line slitting of knocked down boxes is accomplished by forming a shingle of the boxes as they exit the flexo, unshingling the boxes downstream and feeding them one at a time through a conventional shear-type slitter, and then separately reshingling or stacking each of the series of half-size boxes. However, this process is slow, causes loss of box registration, and still results in ragged slit edges on the boxes.

SUMMARY OF THE INVENTION

In accordance with the present invention, knocked down boxes from a flexo-folder-gluer are slit on-line by forming them into a shingle, aligning the shingle laterally as it is being conveyed to obtain accurate edge registration, and slitting the shingle with a single high speed blade to provide accurate and smooth slit edges.

The method of the present invention includes the basic steps or reorienting the boxes exiting the flexo for movement in a direction transverse to the box fold lines; forming a shingle of the boxes in the direction of movement, conveying the shingle longitudinally in its direction of formation; aligning the lateral edges of the shingle while conveying by shifting the boxes transversely; slitting the shingle longitudinally with a rotary slitting blade positioned with the axis of rotation above the shingle, while supporting the underside of the shingle below and on the opposite sides of the blade immediately adjacent the slit edges of the shingle.

In one embodiment, the reorienting and shingling steps are performed simultaneously. In another embodiment, the reorienting step comprises stacking the boxes exiting the flexo in a vertical stack and turning the stack 90°. In a subsequent step, the shingle is formed of boxes from the stack. A conventional turntable may be utilized to reorient the stack 90°. Alternately, the stack turning step may be performed with a right angle conveyor. In an alternate reorientation step, each box may be individually turned through a 90° horizontal angle as it exits the flexo.

DETAILED DESCRIPTION OF THE PREFERRED EMBODIMENTS

Figure 6:
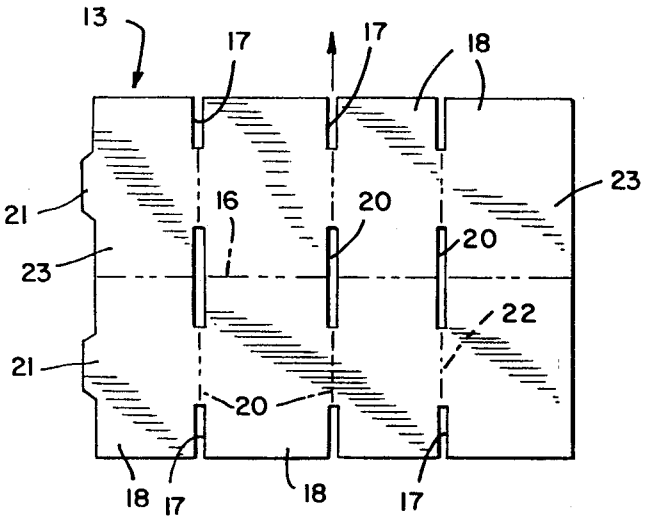
FIG. 6 is a top plan view of the blank used to make a special slotted container for subsequent slitting in the system of the present invention.

In each of FIGS. 1-5, knocked down boxes of the type to be slit in the system of the present invention are formed from corrugated paperboard blanks in a conventional flexo-folder-gluer 10, hereinafter conveniently referred to as a flexo. The flexo 10 comprises a flexographic printer 11 and a combined folding and gluing apparatus 12. A paperboard blank 13 of the type shown, for example, in FIG. 6 is fed into the flexo 10 in the direction shown by the arrow in FIG. 6. A folded and glued knocked down box 14 (hereinafter sometimes referred to as a KDB) is formed in-line in the flexo and exits the folding and gluing apparatus 12 without change in its direction of movement. A KDB 14 is shown in FIG. 7, formed from the blank 13 of FIG. 6.

The special blank 13 allows the formation of a special large KDB 14 which actually comprises two integrally connected half-size regular slotted containers 15 which must be separated by slitting the KDB medially on a slit line 16 transverse to its direction of movement through the flexo 10. The special blank 13 includes the usual front and rear edge slots 177 which define the closure flaps 18 for either the top or bottom of the box erected from one of the half-size regular slotted containers 15. The blank 13 also includes intermediate center slots 20 which are eventually split in half by the slit line 16 to provide the slots opposite the edge slots 17 also defining flaps 18 of the RSCs 15. The blank also includes a pair of glue tabs 21 extending from one lateral edge. The blank 13 is prescored to form fold lines 22 aligned with the slots 17 and 20. The lateral edge panels 23 of the blank are folded toward each other in the folding/gluing apparatus 12 along the two laterally outer fold lines 22 and the glue tabs 21 are glued to the overlapping edge of the opposite edge panel 23, all in a conventional and well known manner. The special slotted container in the form of knocked down box 14 is subsequently reoriented 90° and cut along the slit line 16 utilizing the system of the present invention to form two half-size regular slotted containers 15.

Figure 1:
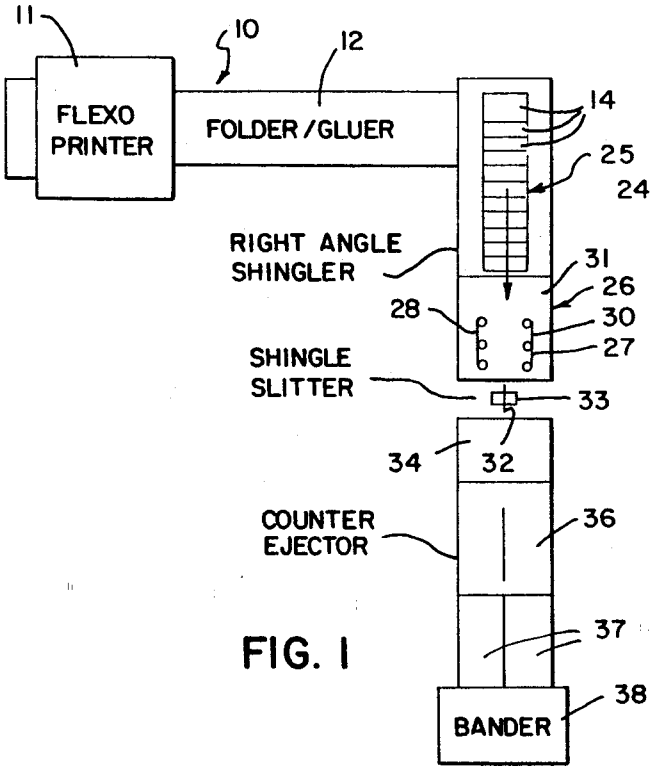
FIG. 1 is a schematic top plan view of one embodiment of the system of the present invention operating in a cross transfer mode.
Figure 2:
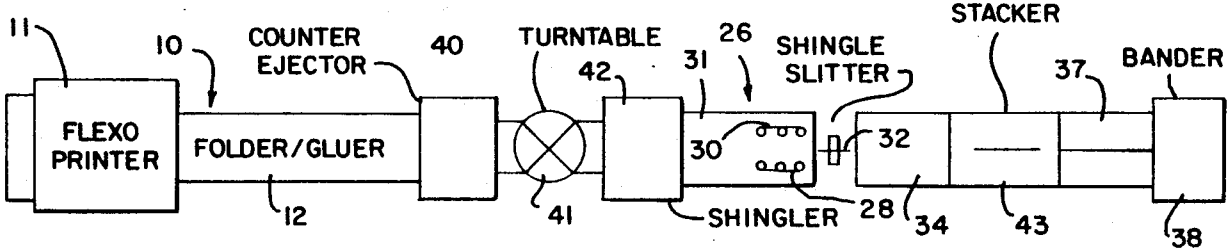
FIG. 2 is a schematic top plan view of another embodiment of the invention operating in an in-line mode.
Figures 3, 4, 5, 7:
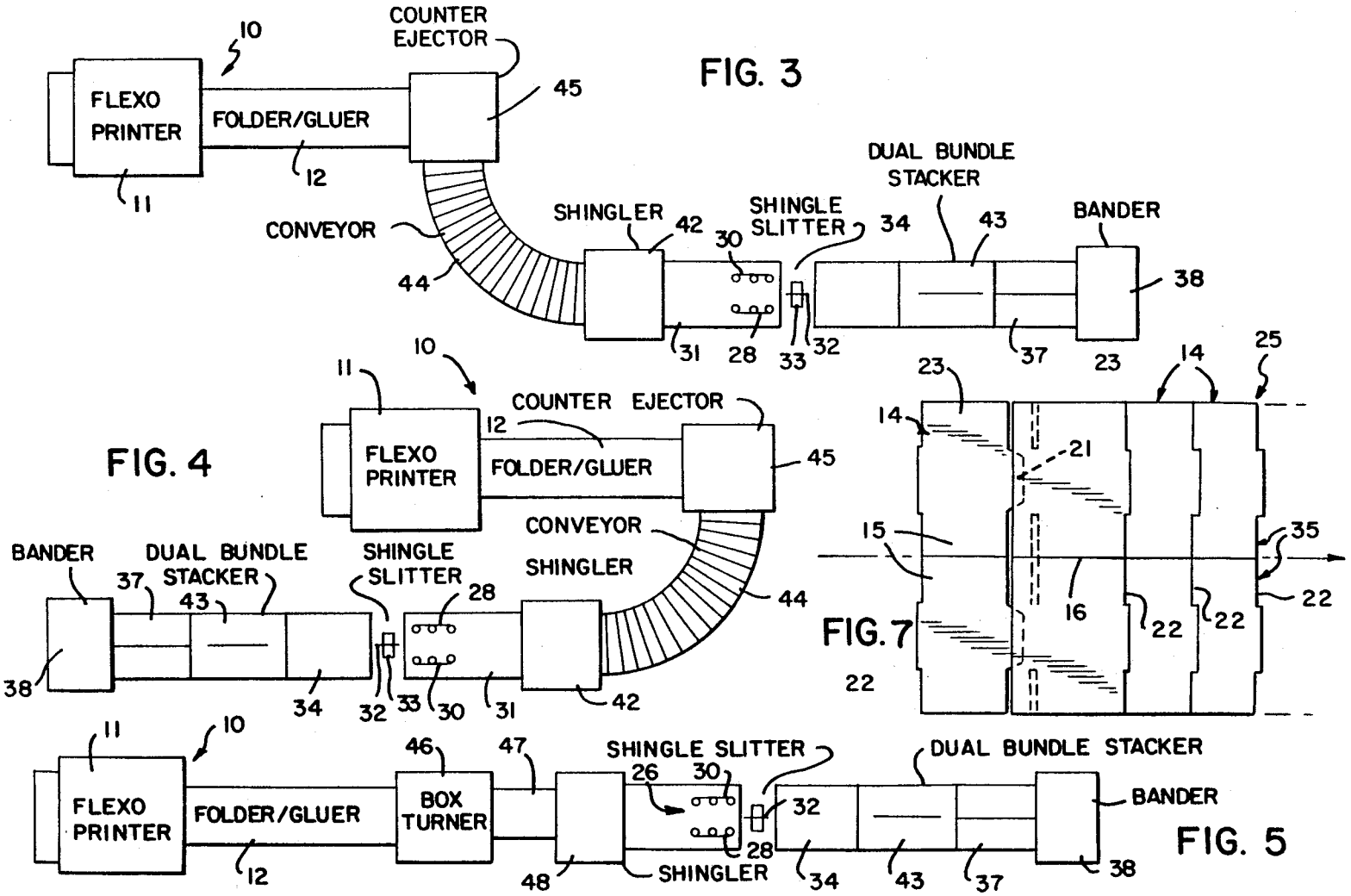
FIG. 3 is a schematic top plan view of another embodiment of the invention operating in a modified in-line mode.
FIG. 4 is a schematic top plan view of another embodiment of the invention shown operating in a reverse in-line mode.
FIG. 5 is a schematic top plan view of yet another embodiment of the invention similar to FIG. 2 and operating in a direct in-line mode.
FIG. 7 is a top plan view of a shingle of knocked down boxes formed from folded and glued blanks of the type shown in FIG. 6.

Referring to FIGS. 1 and 2, there are shown two basic embodiments of the system of the present invention, each of which is intended to address a particular requirement of the box manufacturer. In FIG. 1, the system embodies a right-angle transfer mode in which the special knocked down boxes 14 are received directly from the output of the folding/gluing apparatus 12 for direct 90° reorientation and movement in a direction transverse to movement through the flexo-folder-gluer 10. This system may be attractive where space requirements longitudinally beyond the end of the folding and gluing apparatus 12 prevent continued in-line movement.

The in-line system of FIG. 2 may be preferable where space limitations permit continued on-line movement and processing of the KDBs 14 in a direction directly in line with processing movement through the flexo 10. The systems of FIGS. 3-5 represent variations in the systems of FIGS. 1 and 2 which may be dictated by space requirements and plant layout.

In FIG. 1, the knocked down boxes 14 exiting the folding/gluing apparatus 12 are discharged onto a shingling conveyor 24 operating at a right angle with respect to movement through the flexo 10. The speed of the shingling conveyor 24 is set so that each KDB 14 leaving the folder/gluer 12 is deposited on the preceding KDB in a partially overlapping position, the result of which is the formation of a shingle which is continuously moving along the conveyor 24.

Although it is known to shingle knocked down boxes received from a flexo-folder-gluer for subsequent slitting, the prior art has always required that the boxes be unshingled and slit one at a time. Further, even when the boxes are slit singly, the double layer configuration of a knocked down box is still difficult to slit with conventional shear-type slitting devices, registration of a single box is hard to maintain, and the result is ragged slits which are often out of register, i.e. not on the true intended slit line 16. Lack of registration may result from skewing of the box during unshingling or lateral shifting while it is being conveyed. Furthermore, the glue applied to the glue tabs 21 will typically not be set if the boxes are immediately slit. The result may be an undesirable shifting of the intended glue line and a so-called "fish tailing"0 causing a loss of square in the knocked down box 14.

On-line slitting utilizing the system of the present invention eliminates all of the foregoing defects. Referring again to FIG. 1, the shingle 25 of knocked down boxes 14 (which shingle is also shown in FIG. 7) is transferred directly into an alignment station 26 where the lateral edges of the boxes in the shingle are aligned vertically by shifting the boxes transversely to the direction of conveying movement with an alignment device 27. The alignment device 27 may be of any suitable construction, such as that shown in our copending application Ser. No. 557,221, entitled "Slitting Shingled Sheets", filed on Jul. 24, 1990. The alignment device 27 preferably includes a stationary guide 28 defining the position of one lateral edge of the shingle 25 in its desired centered position and against which the individual boxes 14 in the shingle may be moved laterally by a movable guide 30 to provide accurate registration of each box in the shingle. Only slight lateral movement of the boxes 14 is typically required, but is necessary to assure the shingle is properly centered and no individual boxes are skewed or laterally displaced. Shingle alignment is accomplished while the shingle is being conveyed and the alignment station 26 may include a separate supporting belt conveyor 31 or the shingling conveyor 24 may be extended into the alignment station.

The advancing shingle, supported on the belt conveyor 31 and maintained in registration by the alignment device 27 is conveyed into a rotary slitting blade 32 mounted with its axis of rotation above the shingle and with the outer edge of the cutting blade extending below the lower surface thereof. Immediately below the cutting blade, the shingle is supported by slotted split cylindrical idler roller 33. The edge of the slitting blade 32 which extends below the lower surface of the shingle 25 is received in the slot in the roller 33 such that the portions of the roller support the boxes being slit immediately adjacent their slit edges. A preferred type of rotary slitting blade 32 and lower supporting roller 33 are described in greater detail in the above identified copending application.

An important benefit of shingling the special knocked down boxes 14 right out of the flexo 10 is that the stacking weight of the overlapping boxes tends to hold the glue tabs 21 in correct engagement with the overlapping edge panel 23 as the glue sets. Furthermore, effecting lateral edge alignment of the boxes 14 in the shingle 25 by the alignment device 27 will tend to re-square any boxes which have fish tailed as a result of upstream handling.

The belt conveyor 31 in the alignment station 26 terminates just short of the slitting blade 32 and the slit shingle is received and conveyed away from the slitting blade on a belt conveyor 34 or the like. Belt conveyor 34 carries two separate shingles 35 of half-size regular slotted containers 15, as shown in FIG. 7. From the downstream end of belt conveyor 34, each of the RSC shingles 35 is vertically stacked on a two station counter ejector 36 which places a precisely counted number of RSCs in a vertical stack. The counter ejector may comprise any type of stacking devices operating in a generally known manner. Each stack of RSCs is taken off the counter ejector 36 by one of a pair of belt conveyors 37 and fed into a bander 38 where the stack is tied with a strap, utilizing well known apparatus and methods.

In FIG. 2, the system shown is fully in-line and, as a result, 90° reorientation of the knocked down boxes 14 from the flexo 10 must be effected in-line. In the FIG. 2 system, a counter ejector 40 receives the KDBs 14 as they exit serially from the folder/gluer 12 and forms a vertical stack of a precise preselected count. The stack of KDBs is transferred directly to a turntable 41 on which the stack is turned 90° to orient the boxes 14 in the direction of the intended slit line 16 (see FIG. 7). The reoriented stacks are transferred directly into a shingler 42 which basically unstacks the KDBs 14 to form a shingle 25 of the same type formed on the shingling conveyor 24 of the FIG. 1 embodiment. Typically, the shingler 42 operates by unstacking the boxes from the bottom of the stack, but other methods and apparatus may also be used, all in a manner well known in the art. Downstream of the shingler 42, the system is identical to that shown in FIG. 1. Thus, the advancing shingle is carried by a belt conveyor 31 into and through an alignment station 26 including an alignment device 27 previously described. The aligned and registered shingle 25 is fed directly into the nip formed by a slitting blade 32 and supporting roller 33 where it is accurately and cleanly slit along the median slit line 16. The slit pair of identical shingles 35 of regular slotted containers 15 continue along belt conveyor 34 into a dual bundle stacker 43, which may be identical to the counter ejector 36 in the FIG. 1 system. The vertical stacks of RSCs 15 are moved onto parallel belt conveyors 37 and into the bander 38 all in the manner previously described.

The systems shown in FIGS. 3 and 4 are basically the same and represent combinations of right angle transfer and in-line slitting, both of which, however, are capable of providing accurate and clean slitting of knocked down boxes in a true on-line process as do the systems previously described. The components of the FIGS. 3 and 4 systems are identical, the only difference being the orientation of the right angle conveyor 44. In a manner initially similar to the FIG. 2 system, the knocked down boxes 14 exiting the folder/gluer 12 are stacked vertically in a counter ejector 45. From the counter ejector, the stacks are transferred laterally onto a right angle conveyor 44 which essentially conveys each stack in a 90° turn to reorient the folded edges 22 of the boxes in the stack, so that the edges are transverse to the intended slit line 16 in the manner previously described. The right angle conveyors 44 of FIGS. 3 and 4 are, respectively, left and right turn conveyors, but otherwise are identical. The right angle conveyors may comprise powered belt turns, powered rollers, or any other type of conveyor capable of turning the stack and reorienting the box edges. From the downstream end of the right angle conveyor 45 in either the FIG. 3 of FIG. 4 embodiment, the stack of boxes 14 is unstacked to form a shingle 25 in a shingler 42 of the same type described with respect to the FIG. 2 embodiment. Similarly, the shingle proceeds through an alignment station 26, slitting blade 32, dual bundler stacker 43 and bander 38 in a manner identical to the systems previously described.

In the modified full in-line system shown in FIG. 5, the basic difference from the system shown in FIG. 2 is that no stack is initially formed from the boxes exiting the folder/gluer 12, but rather the boxes are individually turned and then shingled. Thus, each knocked down box 14 from the folder/gluer 12 is turned 90° on a box turner 46 to reorient the folded edges 22 of the KDBs 14 in essentially the same manner previously described. The box turner 46 may be constructed to operate in any manner which will accurately and rapidly turn the box 14 90° to reorient the edge. For example, the box may be held at one corner by moving it into a stop and pivoted about the stop by an overspeed belt under the box opposite the corner at which it is held. From the box turner 46, the boxes exit consecutively onto a conveyor 47 which directs them serially onto a shingler 48 to form a shingle 25 of a type previously described. The shingler 48, however, is unlike the shingler 42 utilized in the FIGS. 2–4 embodiments which essentially operate as unstacking devices. The shingler 48, on the other hand, forms a shingle by slowing a downstream box 14, as by applying a vacuum holding force to its upstream bottom surface, and allowing the next upstream box to overrun and partially overlap the retarded box. A shingler 48 of this type is well known in the art.

A possible drawback in the system of FIG. 5 as compared to the systems of FIGS. 1–4, is that the individual knock down boxes 14 are turned immediately upon exiting the folder/gluer 12 before the glue may be set and without any shingling or stacking which might otherwise help hold the glued parts in alignment. Nevertheless, depending upon the setting time of the glue used, the downstream alignment station 26 might be utilized to resquare any boxes in the shingle which were previously knocked out of square.

Each of the variant systems shown and described with respect to FIGS. 1-5 provides the capability of maintaining precise registration and clean longitudinal slits in knocked down boxes on a true on-line basis directly from a flexo-folder-gluer. The unique combination of elements and process steps provides an enhanced production capability not previously attainable and, in addition, allows a typical flexo to be utilized to accurately and efficiently manufacture small corrugated paperboard boxes which could not previously be made economically.

Various modes of carrying out the present invention are contemplated as being within the scope of the following claims particularly pointing out and distinctly claiming the subject matter which is regarded as the invention.

I claim:

1. A method for on-line slitting of knocked down boxes having fold lines and opposite lateral edges exiting from a folding and gluing apparatus in a direction parallel to the box fold lines, said method comprising the steps of:

(1) orienting the boxes for movement in a direction transverse to the fold lines;

(2) forming a shingle of the boxes in said transverse direction, said shingle having a top side and an underside;

(3) conveying the shingle in the direction of formation;

(4aligning the lateral edges of the boxes in the shingle while conveying by shifting the boxes transversely to the conveying direction;

(5) slitting the aligned shingle longitudinally while conveying with a rotary slitting blade having an axis of rotation thereof above the shingle; and, (6) supporting the underside of the shingle below and on opposite sides of the blade immediately adjacent the slit edges of the shingle.

2. The method as set forth in claim 1 wherein said orienting and shingling steps are performed simultaneously.

3. The method as set forth in claim 1 including the steps of:

(1) stacking the boxes exiting the folding and gluing apparatus in a vertical stack;

(2) performing said box orienting step by turning the stack 90°' and, (3) forming the shingle of boxes from the stack.

4. The method as set forth in claim 3 wherein said stack turning step is performed with a turntable.

5. The method as set forth in claim 3 wherein said stack turning step is performed with a right angle conveyor.

6. The method as set forth in claim 1 wherein said orienting step comprises turning each box individually through a 90° horizontal angle.

7. An apparatus for on-line slitting of knocked down boxes having fold lines and opposite lateral edges exiting from a folding and gluing apparatus in a direction parallel to the box fold lines, said apparatus comprising:

means for reorienting the boxes for movement in a direction transverse to the fold lines;

means for forming a shingle of the boxes in said transverse direction;

means for conveying the formed shingle in the direction of formation thereof;

means for shifting the boxes transversely while conveying to align vertically the lateral edges of the boxes in the shingle;

a rotary slitting blade positioned with a blade axis of rotation above the shingle and positioned to slit the shingle longitudinally while the same is being conveyed; and, means for supporting the shingle from below and on opposite sides of the blade, said supporting means disposed immediately adjacent the slit edges of the shingle.

8. The apparatus as set forth in claim 7 wherein said means for orienting boxes and said means for forming a shingle comprises a right angle shingler positioned to receive the boxes directly from the folding and gluing apparatus.

9. The apparatus as set forth in claim 7 wherein said means for reorienting the boxes comprises:

a stacker; and, means for turning the stack 90°.

10. The apparatus as set forth in claim 9 wherein the means for turning the stack 90° comprises a turntable.

11. The apparatus as set forth in claim 9 wherein the means for turning the stack comprises a right angle conveyor.

12. The apparatus as set forth in claim 7 wherein said means for orienting the boxes comprises an individual box turner.

13. An apparatus for on-line slitting of knocked down boxes having fold lines and opposite lateral edges as they exit from a folder/gluer apparatus in a direction parallel to the box fold lines, said apparatus comprising:

means for receiving and reorienting the boxes from the folder/gluer for movement in a direction transverse to the fold lines;

means for shingling the boxes in said transverse direction to form a shingle having a top side and an underside;

conveying means for moving the shingle in the direction of formation;

means for aligning the lateral edges of the boxes in the moving shingle, including means for shifting the boxes transversely to the direction of shingle movement;

slitting means including a rotary slitting blade positioned with a blade axis of rotation above the top side of the shingle with the blade edge extending downwardly below the underside of the shingle and means for supporting the underside of the shingle below the slitting blade and on opposite sides of the blade to receive the blade therebetween; and, said blade and supporting means forming a nip into which the shingle is moved by said conveying means to slit the boxes longitudinally in the direction of the shingle movement.

* * * * *